US011447941B1

(12) United States Patent
Petrillo

(10) Patent No.: US 11,447,941 B1
(45) Date of Patent: Sep. 20, 2022

(54) SINK SAVIOR

(71) Applicant: Justin Anthony Petrillo, Springfield, MO (US)

(72) Inventor: Justin Anthony Petrillo, Springfield, MO (US)

( * ) Notice: Subject to any disclaimer, the term of this patent is extended or adjusted under 35 U.S.C. 154(b) by 0 days.

(21) Appl. No.: 17/507,977

(22) Filed: Oct. 22, 2021

(51) Int. Cl.
*E03C 1/264* (2006.01)

(52) U.S. Cl.
CPC ..... *E03C 1/264* (2013.01)

(58) Field of Classification Search
CPC ..... E03C 1/264; E03C 1/26; A47K 1/06
USPC ..... 4/292
See application file for complete search history.

(56) References Cited

U.S. PATENT DOCUMENTS 2,426,025 A * 8/1947 Justin ..... A47K 1/06 4/292
3,912,638 A 10/1975 Beaubien
4,205,710 A 6/1980 Dunicz
6,921,480 B2 7/2005 Post
7,951,292 B1 * 5/2011 De La Torre ..... E03C 1/264 210/336
9,834,916 B1 * 12/2017 Kalaydjian ..... B01D 17/10
9,930,999 B1 * 4/2018 De La Hoz ..... A47K 1/06
11,000,788 B2 5/2021 Salani
2003/0146144 A1 * 8/2003 Votel ..... B01D 29/27 210/348
2010/0051562 A1 3/2010 Coleman
2011/0094021 A1 * 4/2011 Ychie ..... E03C 1/264 4/292
2015/0167279 A1 * 6/2015 Goebel ..... A01K 13/001 4/292
2016/0053472 A1 * 2/2016 Rosko ..... E03C 1/2302 4/292
2019/0150674 A1 * 5/2019 Grinberg ..... B65F 1/002

* cited by examiner

*Primary Examiner* — Benjamin R Shaw
(74) *Attorney, Agent, or Firm* — Volta Law Group

(57) ABSTRACT

A tarp or sheet attached to the wide end of a conical funnel designed to fit snuggly in a drain to provide a protective barrier for a sink when cleaning paint brushes and roller covers. The conical funnel may contain a grated filter inside to catch paint clots that would otherwise clog the sink or damage the garbage disposal.

1 Claim, 3 Drawing Sheets

SINK SAVIOR

CROSS-REFERENCES TO RELATED APPLICATIONS

Not Applicable.

FIELD OF INVENTION

The present invention relates generally to a cleaning product for use with painting tools, such as brushes and rollers.

BACKGROUND OF THE INVENTION

It can be difficult to clean paint brushes and rollers in a home or workshop without causes damage to the sink you are using to clean them. A sink can commonly become damaged by paint residue staining the basin or dried paint clogging the drain. Removing paint residue typically requires the use of hydrocarbon solvents which can be damaging when used on some materials, for example natural stone basins such as marble, or may require being vigorously scrubbed off using steel wool or the equivalent, which can likewise ruin the finish of some basins.

In sinks with garbage disposals installed, clumps of paint running down into the garbage disposal can cause significant damage and may even require the garbage disposal to be replaced.

It may, therefore, be advantageous to provide a product to allow painting equipment and brushes to be cleaned in a sink while protecting the sink's basin and drain against damage.

SUMMARY OF THE INVENTION

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. The present invention is defined by the claims.

Embodiments of the present invention are directed towards a conical funnel containing a grated filter inside. The wide end of the funnel may snuggly fits into a common sink drain opening, allowing the rest of the funnel to hang inside the drain. A tarp or sheet may be attached to the wide end of the funnel such that it may be spread inside the sink basin and then attached to the countertop. This provides a protective barrier so one can clean paint brushes and roller covers out in a traditional sink without needing to clean the sink afterwards. Further, embodiments of the present invention may catch any larger dried or semi-dried pieces of paint for easy disposal and to prevent expensive damage to garbage disposals and/or drains.

BRIEF DESCRIPTION OF THE DRAWINGS

The present invention is described in detail below with reference to the attached drawing figures, wherein.

DETAILED DESCRIPTION OF THE INVENTION

Some embodiments of the present invention are described with specificity herein to meet statutory requirements. However, the scope of the invention is not intended to be defined by the description itself. The claimed subject matter may be embodied as to include different features, elements, components, steps, or combinations of steps, similar to those described herein, and in combination with other existing or future technologies. Moreover, although the term "step" might be used to connote different elements of the methods employed, this term should not be interpreted as implying any particular order among or between various steps herein disclosed unless and except the order of individual steps is explicitly described or required.

Some Embodiments of the present invention are directed towards a conical funnel containing a grated filter inside. The wide end of the funnel may snuggly fits into a common sink drain opening, allowing the rest of the funnel to hang inside the drain. The conical funnel may comprise any sufficiently sturdy, chemical- and water-resistant material, including but not limited to various plastics, aluminum, steel, and the like.

A tarp or sheet may be attached to the wide end of the funnel such that it may be spread inside the sink basin and then attached to the countertop. This provides a protective barrier so one can clean paint brushes and roller covers out in a traditional sink without needing to clean the sink afterwards. Further, embodiments of the present invention may catch any larger dried or semi-dried pieces of paint for easy disposal and to prevent expensive damage to garbage disposals and/or drains.

Figure 1:
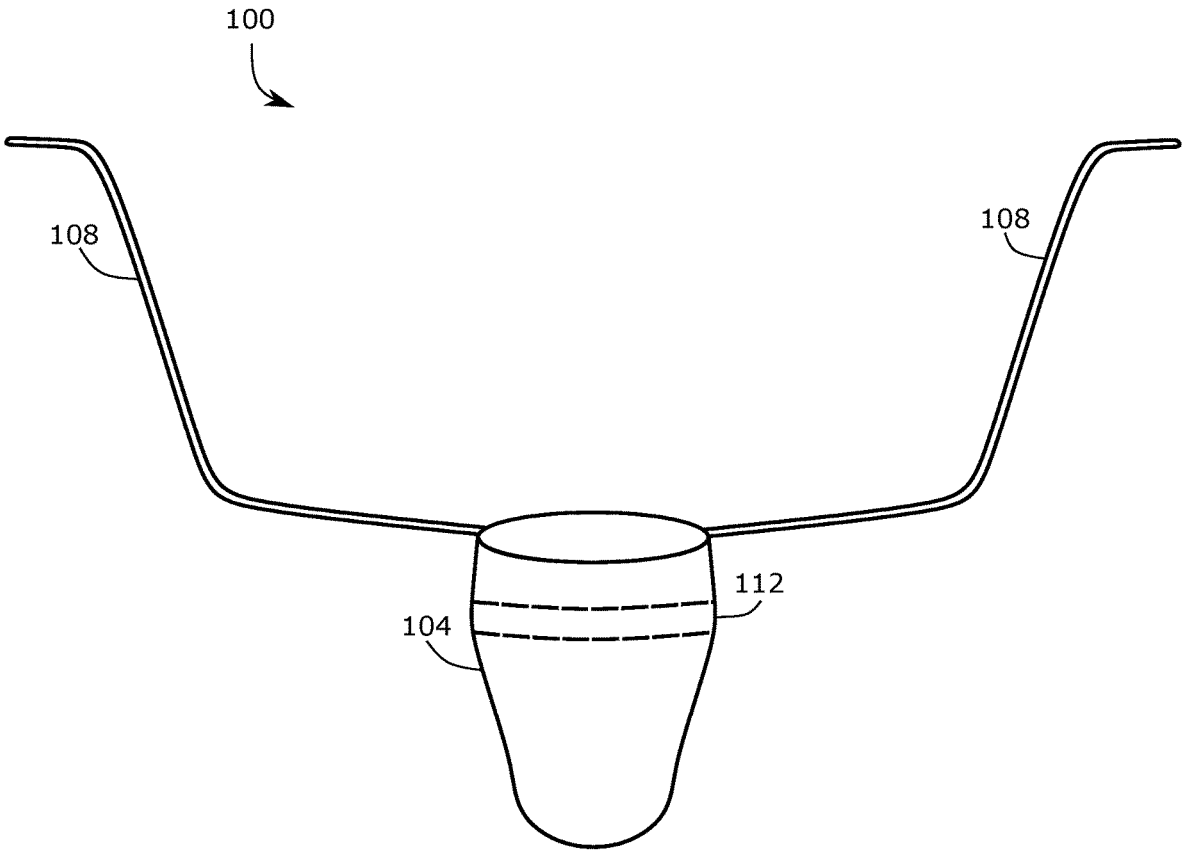
FIG. 1 illustrates a side view of an exemplary embodiment of the present invention.

FIG. 1 provides a side view 100 of an exemplary embodiment of the present invention. As depicted, a conical filter component 104 is attached to a tarp component 108. The conical filter component 104 is configured to snuggly fit into a standard sized kitchen sink opening, having a diameter of 3⅜". One having ordinary skill in the art will appreciate that different versions of the conical filter component 104 may be produced to accommodate different size drain openings. Tarp component 108 is configured to cover the basin of a sink and to be attached to a countertop around the sink. Tarp component 108 may be attached to the countertop by various means including, but not limited to, tape, self-adhesive strips, suction cups, non-slip material, or the like. Tarp component 108 may comprise any sufficiently durable and flexible material to prevent contact between the painting tools, paint, paint residue, etc. and the sink basin. Such sufficiently durable and flexible material may include, but are not limited to, thermoplastic polymer sheets, flexible polyvinyl chloride (PVC), waterproof canvas, and the like. Screen component 112 is contained within conical filter component 104. Screen component 112 is better shown in the following figures.

Figure 2:
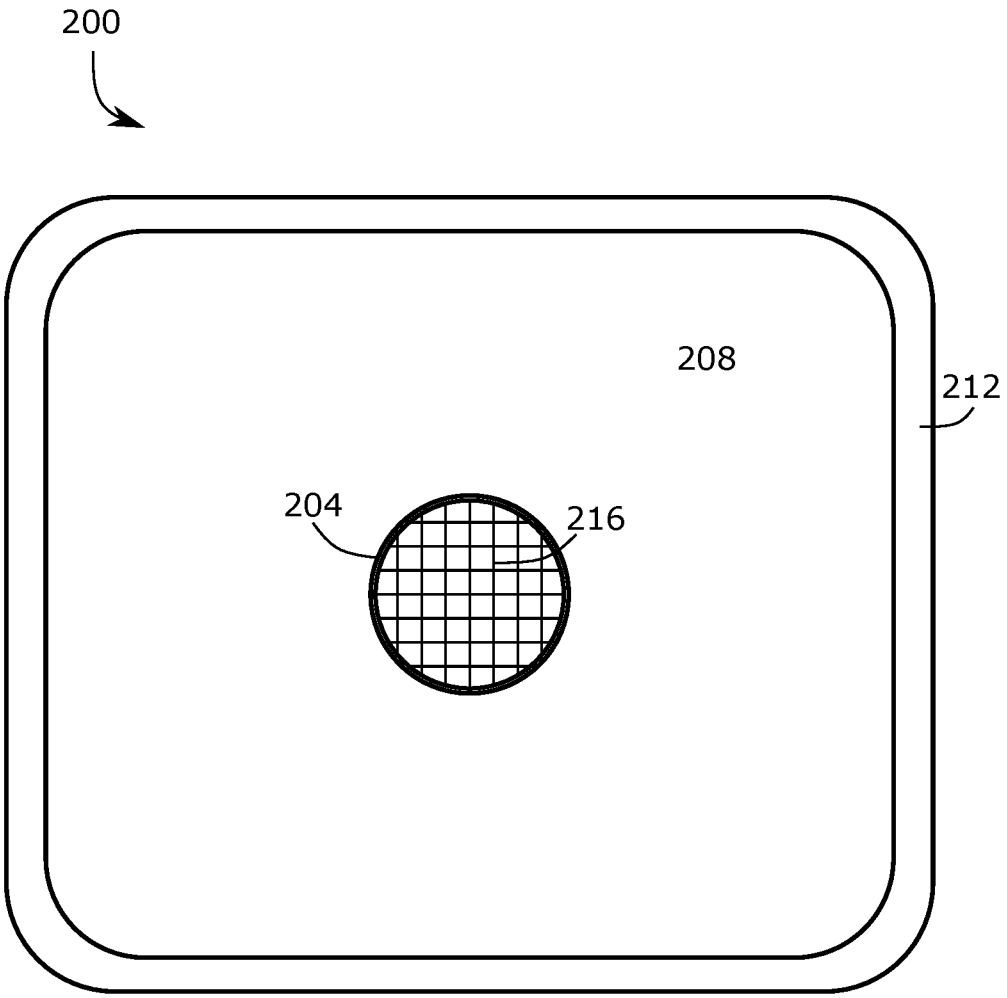
FIG. 2 illustrates a top view of an exemplary embodiment of the present invention.

FIG. 2 provides a top view 200 of an exemplary embodiment of the present invention. As depicted, conical filter component 204 is centrally located within the tarp component 208. Adhesive component 212 may be provided around the peripheral edge of the tarp component 208. Adhesive component 212 may be used to secure the tarp component 208 to a countertop around a sink to preventive the tarp component 208 from being displaced and prevent paint or paint residue from contacting the basin. As depicted, conical filter component 204 includes screen component 216 which collects large clots of dried or semi-dried paint and prevents them from clogging the drain or damaging sink components, such as garbage disposals.

Figure 3:
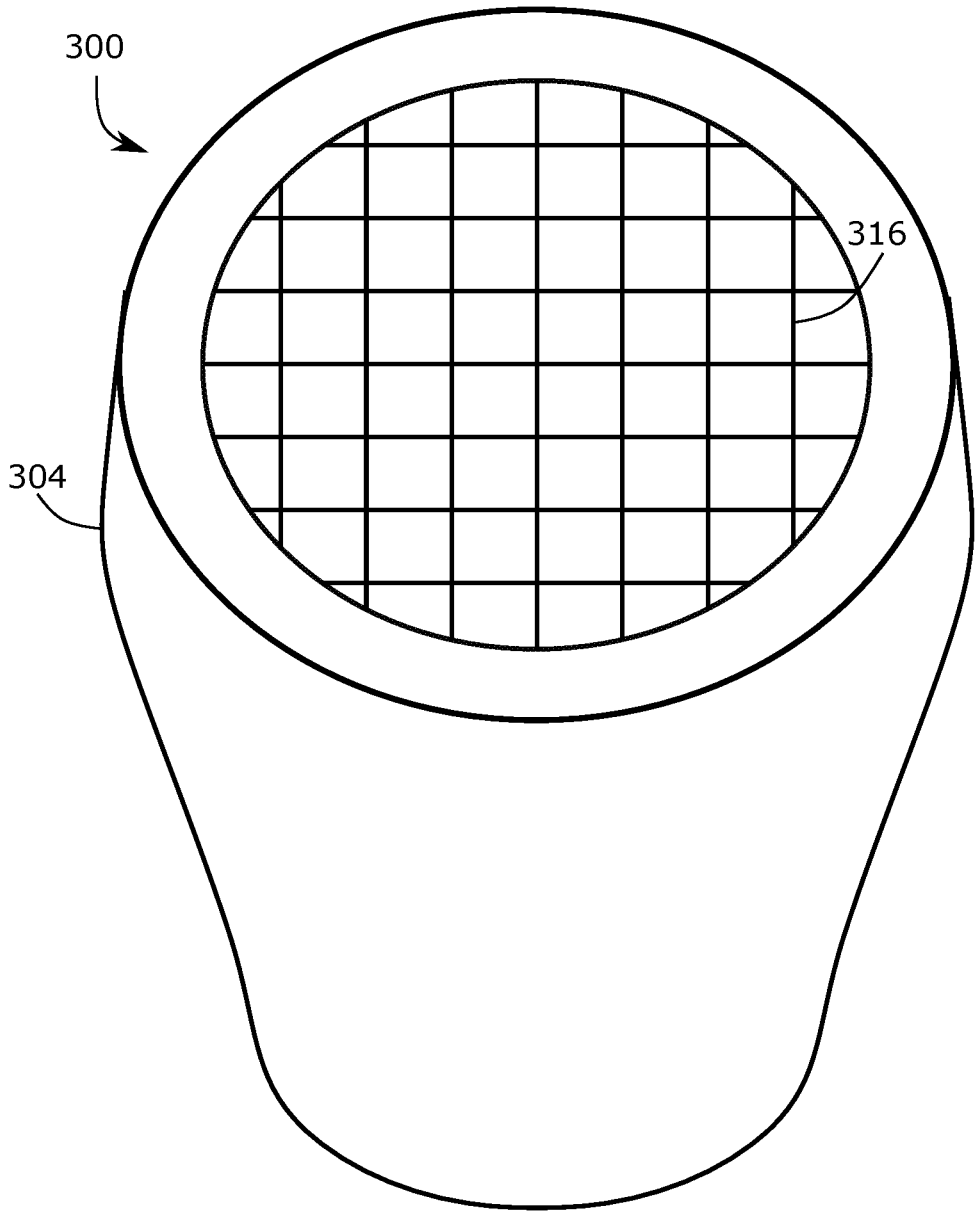
FIG. 3 illustrates a perspective view of the conical filter component of an exemplary embodiment of the present invention.

FIG. 3 illustrates a perspective view of the conical filter component according to an exemplary embodiment of the present invention. As depicted, conical filter component 304 includes screen component 316. Screen component 316 comprises a mesh and may be made of any suitable material, including but not limited to stainless steel wire mesh, aluminum wire mesh, nylon mesh and the like. In some embodiments, the mesh may have an ⅝" mesh size.

Embodiments of the present invention have been described, as required by statute, to be illustrative, but should not be interpreted to be restrictive. One having skill in the art will recognize that many different arrangements of the various components depicted are possible without departing from the scope of the claims below, as well as arrangements including components not explicitly shown.

One having skill in the art will understand that certain combinations and/or sub-combinations of elements and features are of utility and may be employed without reference to other combinations and/or sub-combinations and are contemplated within the scope of the claims. Not all steps listed in the various figures need be carried out in the specific order described.

What is claimed is:

1. An apparatus comprising:

a filter component having a top end, wherein the filter component is configured to fit in a drain of a sink;

a tarp component attached to the top end of the filter component;

an adhesive component configured to secure the tarp component to a countertop around the sink;

a mesh component configured to fit into the filter component, wherein the mesh component is further configured to prevent dried or semi-dried paint clots from entering the drain of the sink.

* * * * *